United States Patent [19]

Takahashi et al.

[11] Patent Number: 4,576,906

[45] Date of Patent: Mar. 18, 1986

[54] COLOR DIFFUSION TRANSFER PHOTOGRAPHIC ELEMENT WITH HEAT TREATED PYRAZOLIDINONE DEVELOPER

[75] Inventors: Osamu Takahashi; Minoru Sakai, both of Kanagawa, Japan

[73] Assignee: Fuji Photo Film Co., Ltd., Kanagawa, Japan

[21] Appl. No.: 751,093

[22] Filed: Jul. 2, 1985

Related U.S. Application Data

[63] Continuation-in-part of Ser. No. 631,418, Jul. 16, 1984, abandoned.

[30] Foreign Application Priority Data

Jul. 14, 1983 [JP] Japan ..... 58-128226

[51] Int. Cl.[4] ..... G03C 5/54; G03C 1/40; G03C 1/42; G03C 5/30

[52] U.S. Cl. ..... 430/497; 430/218; 430/349; 430/483

[58] Field of Search ..... 430/218, 483, 344, 497

[56] References Cited

U.S. PATENT DOCUMENTS 3,261,685 7/1966 Dettaes et al. ..... 430/483
4,266,025 5/1981 McCreary et al. ..... 430/218

OTHER PUBLICATIONS

Lee, "The Degradation . . . Solution", *Photo. Sci. and Engrg.*, vol. 8, 1964, p. 120.

*Primary Examiner*—Richard L. Schilling
*Attorney, Agent, or Firm*—Sughrue, Mion, Zinn, Macpeak & Seas

[57] ABSTRACT

A color diffusion transfer photographic element which comprises a support having provided thereon at least one silver halide emulsion layer containing a non-diffusible redox compound capable of releasing a diffusible dye or a precursor thereof by processing with an alkaline processing solution containing 3-pyrazolidinone type developing agent in the presence of a silver halide developing agent after exposure to light, wherein said alkaline processing solution is subjected to a heat treatment before use under a substantially oxygen-free condition for at least T days, wherein T is represented by the formula $$\log T = \left(\frac{50 - X}{10}\right) \log 5 \qquad \text{(I)}$$

wherein X represents the maximum temperature at which the heated alkaline processing solution is held, provided that X is about 40° C. or more.

18 Claims, 2 Drawing Figures

COLOR DIFFUSION TRANSFER PHOTOGRAPHIC ELEMENT WITH HEAT TREATED PYRAZOLIDINONE DEVELOPER

This is a continuation-in-part of application Ser. No. 631,418 filed July 16, 1984, now abandoned.

FIELD OF THE INVENTION

The present invention relates to a color diffusion transfer process, and, in more detail, to a processing solution for a color diffusion transfer process and photographic elements combined with such processing solution.

BACKGROUND OF THE INVENTION

In a color diffusion transfer photographic element using a dye releasing redox compound capable of releasing a diffusible dye (hereinafter referred to as "DRR compound") as a result of a redox reaction with an oxidation product of a developing agent formed by development of silver halide, it is known to add a silver halide developing agent to an alkaline processing composition. Known silver halide developing agents include 3-pyrazolidinones, aminophenols, phenylenediamines and reductones, etc. The best available silver halide developing agents thereof are the 3-pyrazolidinones, from the viewpoint of low degree of stain (low Dmin stain) and high efficiency of reaction between the oxidation product and the dye releasing redox compound. However, an alkaline processing solution containing 3-pyrazolidinones as the silver halide developing agent is disadvantageous in that the performance thereof changes with the passage of time. It is noted in this regard that such processing solution typically is put on sale in the form of an instant photographic film containing the processing solution, and it often takes a fairly long time before photography is conducted by purchasers of the film. The passage of time has an adverse influence upon photographic properties, e.g., the processing solution increases its sensitivity by the passage of time. A silver halide emulsion layer placed near the processing solution is easily influenced by the change of performance of the processing solution when development is carried out. Accordingly, in the case of multicolor diffusion transfer photography, the balance of each color changes over time to cause deterioration of the quality of images.

SUMMARY OF THE INVENTION

Accordingly, an object of the present invention is to provide a color diffusion transfer photographic element using a developing solution wherein changes due to the passage of time before use, particularly changes of gradation, are greatly inhibited or prevented.

The above-described object has been effectively attained by providing a color diffusion transfer photographic element which comprises a support having provided thereon at least one silver halide emulsion layer containing a non-diffusible redox compound capable of releasing a diffusible dye or a precursor thereof by processing with an alkaline processing solution in the presence of a silver halide developing agent after exposure to light, wherein (a) said alkaline processing solution contains a 3-pyrazolidinone type developing agent, (b) said alkaline processing solution is contained in a container destructible by pressure, (c) said destructible container is assembled into the photographic element in such a position that the processing solution released from said container diffuses into the photographic layers, but said position does not interrupt exposure of the silver halide emulsion layer, and (d) said alkaline processing solution is subjected to a heat treatment before use under a substantially oxygen-free condition for at least T days, wherein T is represented by $$\log T = \left(\frac{50 - X}{10}\right) \log 5 \qquad \text{(I)}$$

wherein X represents the maximum temperature, provided that X is about 40° C. or more.

DETAILED DESCRIPTION OF THE INVENTION

In the above-described formula, the maximum temperature represented by X, means the maximum temperature applied in any step of the heat treatment. For example, in the case that heat treatment is carried out at 30° C. for a certain period of time and thereafter the heat treatment is carried out at 40° C. to the end (or the case that the order of temperature applied is the reverse), within T days the maximum temperature means 40° C.

In carrying out heat treatment, it is preferred to heat at a maximum temperature of from 50° C. to 80° C. for from 1 days to 20 days with the proviso that heat treatment is conducted for at least T days wherein T is represented by the formula:

$$\log T = \log 2 + \left(\frac{50 - X}{10}\right) \log 5$$

wherein X has the same meaning as in formula (I). And it is particularly preferred to heat at a maximum temperature of about 50° C. for about 3 days.

Further, it is necessary to carry out heat treatment under a substantially oxygen-free condition. As a preferred embodiment for this purpose, there is a method which comprises putting a processing solution in a container, which is destructible by pressure, and heating it after sealing it in the container.

In the case of such an embodiment, it is preferred that the maximum temperature applied is 80° C. or less.

The formula represented by (I) is empirically derived based on experimental data.

Figure 2:
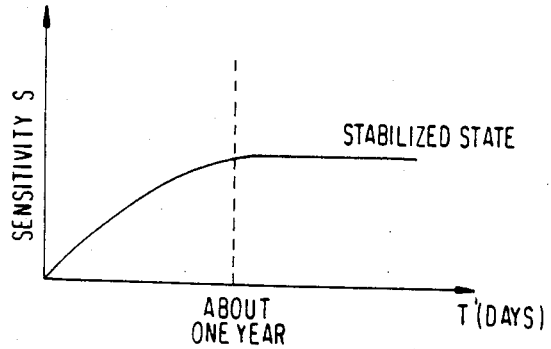
FIG. 2 is an explanatory graph showing a change in a performance of a processing solution.

Processing solution which is not subjected to a heating treatment gradually increases its performance and reaches a stabilized state about one year later as is shown in FIG. 2. FIG. 2 shows the change in the performance of the processing solution. The ordinate represents sensitivity of the light-sensitive material treated by the processing solution and the abscissa represents days (T') during which the processing solution is stored.

An effect of increasing performance of the processing solution before a stabilized state is reached is shown primarily on the silver halide emulsion layer nearest to the place where the processing solution is applied. Generally, the layer primarily influenced by the increasing performance is the blue sensitive layer. Thus, the effects of increasing performance are seen only in the blue sensitive layer, but are not seen in a green sensitive layer, nor in a red sensitive layer, which are more remote from the place where the processing solution is spread. As a result, the apparent sensitivities of the layers differ from each other. This means that the material has poor sensitivity-balance, and furthermore poor color balance. That is, the color reproducibility of the material deteriorates.

The present invention overcomes this problem. In the present invention, the processing solution reaches the stabilized state in a short time by heating artificially in an oxygen-free system, in spite of the fact that it has been believed that 3-pyrazolidinones are decomposed by heating in the prior art.

In the present invention, a correlation between the heating maximum temperature and minimum days was determined to obtain formula I, wherein the expression "minimum days" means the number of days sufficient to reach to a stabilized state, i.e., at least the number of days sufficient to obtain about two-thirds the sensitivity of the stabilized state.

As 3-pyrazolidinones used as the developing agents, 1-aryl-4-substituted-3-pyrazolidinones (wherein the aryl group may be substituted) are preferred examples. Particularly preferred examples are those represented by the formula (II):

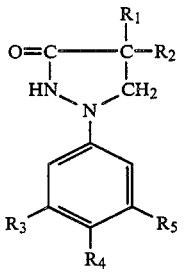

(II)

wherein $R_1$ and $R_2$ each represent a hydrogen atom, a lower alkyl group preferably having 1 to 4 carbon atoms (more preferably, a methyl group), or a hydroxyl substituted lower alkyl group preferably having 1 to 4 carbon atoms (more preferably, a hydroxymethyl group), and $R_3$, $R_4$ and $R_5$ each represent a hydrogen atom, a hydroxyl group, an alkyl group, preferably having 1 to 2 carbon atoms, an alkoxy group preferably having 1 to 2 carbon atoms, an aryloxy group preferably being a phenoxy group, a sulfonamide group, or an aromatic group. These groups (excluding the hydrogen atom and the hydroxyl group) represented by $R_3$, $R_4$ and $R_5$ may have substituents. It is preferred that both $R_3$ and $R_5$ are hydrogen atoms and $R_4$ is a methyl group.

In the present invention, examples of useful 3-pyrazolidinones include compounds having the following $R_1$–$R_5$ groups in the above-described formula (II).

| Compound No. | $R_1$ | $R_2$ | $R_3$ | $R_4$ | $R_5$ |
|---|---|---|---|---|---|
| 1 | H | H | H | H | H |

-continued

| Compound No. | $R_1$ | $R_2$ | $R_3$ | $R_4$ | $R_5$ |
|---|---|---|---|---|---|
| 2 | H | H | H | $CH_3$ | H |
| 3 | H | H | $CH_3$ | H | H |
| 4 | $CH_3$ | H | H | H | H |
| 5 | $CH_3$ | H | H | $CH_3$ | H |
| 6 | $CH_3$ | H | $CH_3$ | H | H |
| 7 | $CH_3$ | H | H | $OCH_3$ | H |
| 8 | $CH_3$ | $CH_2OH$ | H | H | H |
| 9 | $CH_3$ | $CH_2OH$ | H | $CH_3$ | H |
| 10 | $CH_3$ | $CH_2OH$ | $CH_3$ | H | H |
| 11 | $CH_3$ | $CH_2OH$ | H | $CH_2CH_3$ | H |
| 12 | $CH_2OH$ | $CH_2OH$ | H | H | H |
| 13 | $CH_2OH$ | $CH_2OH$ | H | $CH_3$ | H |
| 14 | $CH_2OH$ | $CH_2OH$ | $CH_3$ | H | H |
| 15 | $CH_3$ | $CH_2OH$ | H | $NHSO_2CH_3$ | H |
| 16 | $CH_3$ | $CH_2OH$ | $NHSO_2CH_3$ | H | H |
| 17 | $CH_3$ | $CH_2OH$ | H | $OCH_2CH_2OH$ | H |
| 18 | $CH_3$ | $CH_2OH$ | H | $CH_2OCH_3$ | H |

The mechanism of the present invention is not completely clear, but the following facts have been noted as a result of various studies.

(1) In the case of providing an oxygen-free state, performance of the processing solution containing 3-pyrazolidinones gradually changes over several years at room temperature, but the change finally completely stops.

(2) This change of performance is very temperature dependent, and the rate of change becomes higher as temperature increases, but the change finally substantially stops similarly to the case at room temperature. This temperature dependence of the change is extremely large (5 times or more with a change of 10° C.) as compared to the temperature dependence of a conventional reaction (2 times with a change of 10° C.).

Hitherto, studies concerning deterioration of the alkaline developing solutions containing 3-pyrazolidinones have been reported. According to these reports, 3-pyrazolidinones are finally completely decomposed in an alkali solution. For example, according to the report in (*J. Photo. Sci.*, Vol. 14, pages 35 (1966)) by L. F. A. Mason, it has been suggested that they are completely decomposed after hydrolysis, as shown in the following.

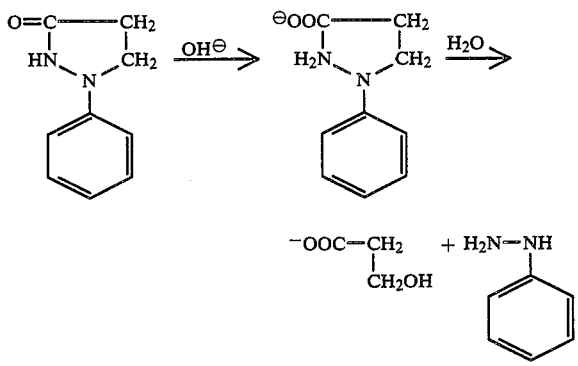

Further, W. E. Lee has examined hydrolysis of 3-pyrazolidinones in an oxygen-free system and has reported that they are finally decomposed into pieces as follows, in *Phot. Sci. Eng.*, Vol. 8, pages 120 (1964).

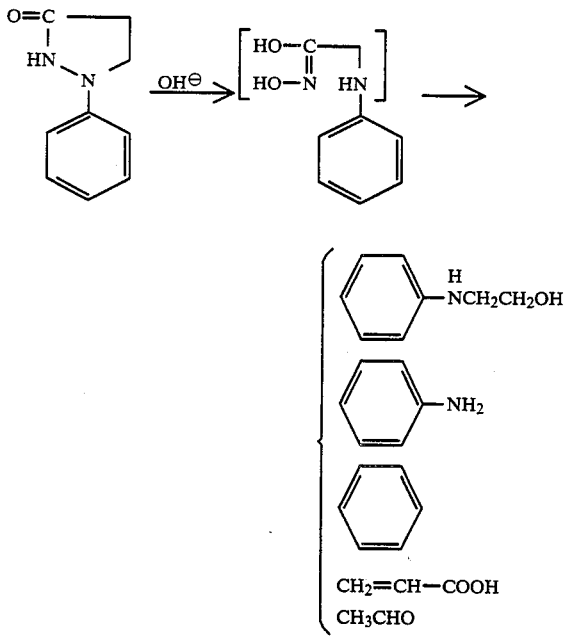

Accordingly, the knowledge that a developing solution of stable performance can be obtained when an alkali solution of 3-pyrazolidinones is allowed to stand in an oxygen-free system at a certain temperature for a given period of time has not been known hitherto at all, which is an unexpected surprising fact different from the prior impressions of those in the art.

The present invention is based on the discovery and application of the above-describd phenomena (1) and (2).

The amount of 3-pyrazoliinones used in the present invention is not restricted, but they are generally used in an amount of from about 1 g/l up to the solubility limit thereof (i.e., the upper limit is the maximum amount of the compound that will dissolve). Preferably, it is in a range of from 5 to 20 g/l.

As the alkalinity providing substances in the alkaline processing solution used in the present invention, alkali metal and other metal hydroxides, such as sodium hydroxide, potassium hydroxide, rubidium hydroxide or cesium hydroxide, etc., are desirably used. Furthermore, alkali metal carbonate such as sodium carbonate and amines such as diethylamine can be used. It is preferred that the alkaline processing solution contain the above-described alkalinity providing substances so as to have a pH of 11 or more.

In the alkaline processing solution used in the present invention, it is preferred to incorporate a thickening agent, such as ethers that are inactive to alkaline solutions, such as hydroxyethyl cellulose or alkali metal salt of carboxymethyl cellulose (for example, sodium carboxymethyl cellulose), etc. The amount of the thickening agent depends on the kind or the degree of polymerization of the thickening agent, but it is generally advantageous to use it in a concentration of from 1 to 10% by weight, based on the total weight of the processing solution. The viscosity is preferred to be in a range of from about 100 to 250,000 cps. In addition to the above-described thickening agents, it is also possible to use polysaccharide gums such as guar gums, xanthanes, and algins as described in *Research Disclosure,* No. 15162, Nov., 1976, as thickening agents.

The alkaline processing solution used in the present invention may contain various agents for providing opacity, such as, for example, carbon black, titanium dioxide and other light-absorbing dyes, for example, indicator dyes the color of which varies depending on the pH.

Further, in the photographic element of the present invention, it is possible to incorporate the various compounds as described below in accordance with the intended purpose, but it is particularly preferred to add them to the alkaline processing solution.

The photographic element of the present invention may contain additives for the purpose of increasing the density of transferred images. For example, aromatic alcohols such as benzyl alcohol or p-xylene-$\alpha,\alpha'$-diol, etc., as described in U.S. Pat. No. 3,846,129 may be used for this purpose. Aliphatic or alicyclic glycols and saturated aliphatic or alicyclic aminoalcohols as described in U.S. Pat. No. 4,030,920, such as 1,4-cyclohexanedimethanol, 1,6-hexanediol, 3-amino-1-propanol, 2-amino-1-propanol, 5-amino-1-pentanol, 6-amino-1-hexanol or 2-amino-2-methyl-1-propanol, etc., may also be added for this purpose.

The photographic element of the present invention may contain compounds as described in U.S. Pat. No. 3,942,987 such as alkali metal fluorides, oxalates, barium salts, etc., for the purpose of preventing pimple-like deformations generating after substantial conclusion of development.

The photographic element of the present invention may further contain compounds as described in U.S. Pat. No. 2,497,917, such as 5-methylbenzotriazole, 5,6-dichlorobenzotriazole, 6-nitrobenzimidazole, histidine, etc.

In the alkaline processing solution used in the present invention, pigments such as carbon black or titanium dioxide may be uniformly dispersed therein. In such cases, dispersing assistants and surface active agents known hitherto can be used. Examples include alkali metal salts of compounds such as polyacrylic acid, naphthalenesulfonic acid, polycondensate of naphthalenesulfonic acid and formalin, polystyrenesulfonic acid, etc. Particularly available carbon black dispersions are those prepared by methods using compounds as described in Japanese Patent Applications (OPI) Nos. 150228/81 and 200862/82 (The term "OPI" as used herein refers to a "published unexamined Japanese patent application").

In order to convert various impurities in the alkaline processing solution into substances substantially harmless to silver halide emulsions, various compounds may be incorporated, including metal salts such as silver nitrate, silver oxide, lead oxide, tin oxide, cadmium oxide, zinc nitrate, mercury oxide, etc.

Light-sensitive silver halide emulsions used in the present invention are hydrophilic colloid dispersions of silver chloride, silver bromide, silver chlorobromide, silver iodobromide, silver chloroiodobromide or a mixture thereof. The halogen composition is selected according to the particular purpose of use and processing conditions to be used for the light-sensitive material, but it is particularly preferred to use silver bromide, silver iodobromide, or silver chloroiodobromide having an iodide content of 10 mole % or less and a chloride content of 30 mole % or less.

In the present invention, it is possible to use both (1) negative emulsions of forming surface latent images and (2) direct reversal emulsions. Examples of the latter type emulsions include internal latent image type emulsions and previously fogged direct reversal emulsions.

In the present invention, it is possible to advantageously use inner latent image type direct reversal silver halide emulsions. As emulsions of this type include, for example, conversion type emulsions, core/shell type emulsions and hetero metal incorporated emulsions such as those described in U.S. Pat. Nos. 2,592,250, 3,206,313, 3,447,927, 3,761,276 and 3,935,014, etc.

Examples of nucleating agents for emulsions of this type, include hydrazines as described in U.S. Pat. Nos. 2,588,982 and 2,563,785, hydrazides and hydrazones as described in U.S. Pat. No. 3,227,552, quaternary salt compounds as described in British Pat. No. 1,283,835, Japanese Patent Publication No. 38164/74 and U.S. Pat. Nos. 4,115,122, 3,734,738, 3,719,494 and 3,615,615, sensitizing dyes having a nucleating substituent in the dye molecule as described in U.S. Pat. No. 3,718,470, and thiourea linking acylhydrazine compounds as described in U.S. Pat. Nos. 4,030,925, 4,031,127, 4,245,037, 4,255,511, 4,266,013, 4,276,364, etc.

Dye-releasing redox (DRR) compounds preferably used in the present invention are immobile under an alkaline processing condition, and can be represented generally by formula (III):

(Ballast)-(Link)-(Dye) (III)

In the formula, (Ballast) represents a ballast group for immobilizing the compound under an alkaline processing condition, (Dye) represents a dye group which can move in the light-sensitive element under at least an alkaline processing condition or a precursor thereof, and (Link) represents a redox cleavage group having the property of cleaving upon oxidation due to development or of preventing cleavage directly or indirectly upon the oxidation.

As particularly preferred DRR compounds used in the present invention, there are negative type DRR compounds, examples of which have been described in Japanese Patent Application (OPI) Nos. 33826/73, 54021/79, 113624/76 and 71072/81, etc. Examples of (Ballast)-(Link)-moieties which can release a diffusible dye under an alkaline condition by development of silver halide include the following groups:

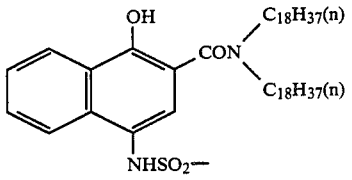

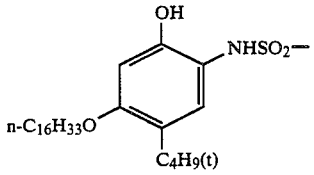

Other useful DRR compounds include compounds having a positive type redox nucleus as described in Japanese Patent Application (OPI) Nos. 111628/74, 63618/76, 4819/77, 110827/78, corresponding to U.S. Pat. Nos. 4,139,379, 110828/78, corresponding to U.S. Pat. Nos. 4,139,379, 130927/79, 164342/81, corresponding to U.S. Pat. No. 4,371,604, U.S. Pat. No. 4,199,354, etc. Particularly preferred compounds are those having a redox carrier moiety represented by formula (IV):

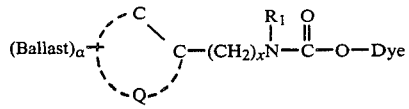

(IV)

wherein Ballast has the same meaning as in the case of formula (III), Q represents a quinone nucleus (which may contain various substituents), x represents an integer of 1 or 2, $R^1$ represents an alkyl group or substituted alkyl group having from 1 to about 40 carbon atoms or an aryl group or substituted aryl group having 6 to 40 carbon atoms, an $\alpha$ is 0 or 1, but is 1 when $R^1$ represents a group having less than 8 carbon atoms.

The dye released from the DRR compound may be a known dye or may be a dye precursor capable of changing into a dye in the photographic processing step or an additional processing step. The dye of the final image may or may not be chelated with a metal. Typical dyes include azo dyes, azomethine dyes, anthraquinone dyes and phthalocyanine dyes, and these may be chelated or not chelated with a metal. Among others, azo type cyan, magenta, and yellow dyes are particularly useful.

Examples of yellow DRR compounds are described, for example, in Japanese Patent Publication Nos. 2618/74 and 12140/82; Japanese Patent Application (OPI) Nos. 114930/76, 64036/78, 79031/79, 23527/79, 111344/79, 16130/81 and 71072/81; U.S. Pat. Nos. 3,309,199, 4,148,641 and 4,148,643; and in *Research Disclosure,* Nos. 17630 (1978) and 16475 (1977).

Examples of magenta DRR compounds are described, for example, in Japanese Patent Publication No. 43950/71; Japanese Patent Application (OPI) Nos. 115528/75, 106727/77, 23628/78, 35533/78, 65034/79, 161332/79, 134/80, 4028/80, 36804/80, 71060/81 and 73057/81; and U.S. Pat. Nos. 3,453,107, 3,932,380, 3,932,381, 3,931,144, 4,207,104, 4,287,292, 4,357,410 and 4,357,412.

Examples of cyan DRR compounds are described in Japanese Patent Publication No. 32130/73, Japanese Patent Application (OPI) Nos. 126331/74, 109928/76, 8827/77, 47823/78, 64035/78, 143323/78, 149328/78, 99431/79, 121125/79, and 71061/81; U.S. Pat. Nos. 4,142,891, 4,147,544, 4,148,642, and 4,195,994; European Patent Nos. 53,037 and 53,040; and in *Research Disclosure,* Nos. 16475 (1975), 16475 (1977), and 17630 (1978).

Further, as a kind of dye precursor, DRR compounds having a dye part, light absorption of which is temporarily shifted in the light-sensitive element, can be used in the present invention. Examples thereof are described in Japanese Patent Application (OPI) Nos.. 53329/80 and 53330/80; U.S. Pat. Nos. 3,336,287, 3,579,334 and 3,982,946; and Brittsh Pat. No. 1,467,317.

The amount of a DRR compound applied is generally in a range of from $1\times10^{-4}$ to $1\times10^{-2}$ moles/m$^2$, and preferably in a range of from $2\times10^{-2}$ to $2\times10^{-3}$ moles/m$^2$.

In the case of reproducing natural color by a subtractive process, light-sensitive materials having at least two, and preferably three, combinations of an emulsion having a selective spectral sensitivity to a certain wavelength range and a DRR compound having a selective spectral absorption in the same wavelength range as the emulsion described above are used.

Particularly, light-sensitive elements having a combination of a blue-sensitive silver halide emulsion and a yellow DRR compound, a combination of a green-sensitive emulsion and a magenta DRR compound, and a combination of a red-sensitive emulsion and a cyan DRR compound are available. These combination units of emulsion and DRR compound may be applied in layers so as to have a face-to-face relation in the light-sensitive material or may be applied as one layer by forming particles of each combination (wherein the DRR compound and the silver halide grains are present in the same particle) and mixing them. Image receiving elements (containing at least a mordanting layer), neutralizing layers, layers for controlling neutralization rate (timing layer), reflection layers, light-shielding layers and cover sheets, etc., capable of use in the photographic element of the present invention include those described, for example, in Japanese Patent Application (OPI) No. 64533/77, corresponding to U.S. Pat. No. 4,268,625.

Examples of polymer mordanting agents that can be used in the mordanting layer include polymers having secondary and tertiary amino groups, polymers having nitrogen containing heterocyclic parts and polymers having quaternary cationic groups, which have a molecular weight of 5,000 or more, and preferably 10,000 or more.

As the container destructible by pressure that can be used in the present invention, it is preferred to use those described, for example, in U.S. Pat. Nos. 2,543,181, 2,643,886, 2,653,732, 2,723,051, 3,056,491, 3,056,492, 3,152,515, etc.

In the case that the photographic element of the present invention is in the form of a photographic film unit, and more particularly in the case of a film unit having such a construction that the photographic processing is carried out by passing the film unit between a pair of pressing members placed in parallel after imagewise exposure to light, it comprises, for example, the following elements:

(1) a base, (2) a light-sensitive element of the type described above, (3) an image receiving element of the type described above (a releasing layer may desirably be placed between (2) and (3)), and (4) a processing element of the type described above.

A very desirable embodiment for the present invention is a type involving superposing layers in a body in the manner disclosed in Belgian Pat. No. 757,959, corresponding to U.S. Pat. No. 3,689,262. According to this embodiment, an image receiving layer, a light reflection layer which substantially shields light (for example, a combination of a $TiO_2$ layer and a carbon black layer) and a single or plurality of light-sensitive layers (light-sensitive element) are applied in turn to a transparent base, and a transparent cover sheet in placed thereon in a face-to-face relation. A container destructible by pressure which accommodates an alkaline processing solution containing an agent for providing opacity (for example, carbon black) in order to shield the light is disposed so as to be adjacent to the top layer (protective layer) of the above-described light-sensitive layers and to the transparent cover sheet. This film unit is exposed to light through the transparent cover sheet. When it is ejected from the camera, the container is destroyed by the pressing members and the processing composition (containing the agent for making opacity) is spread over the whole face between the light-sensitive layer and the cover sheet. Consequently, the light-sensitive layers are shielded from light in a sandwich state, and the development can proceed in the presence of light.

In the film unit of this embodiment, it is desirable to incorporate a neutralization mechanism. It is especially preferred to provide a neutralizing layer on a cover sheet (if necessary, a timing layer is additionally provided on the other side from where the processing solution is spread).

Other available forms of laminating in a body capable of use for the photographic element of the present invention are described, e.g., in U.S. Pat. Nos. 3,415,644, 3,415,645, 3,415,646, 3,635,707, and 3,647,487, and German Patent Application (OLS) No. 2,426,980.

In another preferred embodiment, an image receiving element having a multilayer construction composed of a neutralizing layer, a timing layer, and a mordanting layer on a support and an element comprising a single or plurality of light-sensitive layers on another support (light-sensitive element) are placed in layers so as to have a face-to-face relation, and they are processed by spreading an alkaline processing solution as described herein between both elements. In this case, the image receiving element may be separated after transfer of images. Further, as described in U.S. Pat. No. 3,415,645, the support of the image receiving layer may be transparent, and a reflection layer can be provided between the image receiving layer and the light-sensitive layers, by which images can be observed directly without separating the layers.

In the embodiment type involving separation of the image receiving element from the light-sensitive element after transfer of images, the neutralizing layer and the timing layer can be omitted.

EXAMPLE 1

A light-sensitive material was produced by applying the following layers in turn to a transparent polyethylene terephthalate support.

(1) A mordanting layer containing 3.0 g/m$^2$ of copolymer (styrene-N-vinylbenzyl-N,N,N-trihexylammonium chloride) and 3.0 g/m$^2$ of gelatin.

(2) A light-reflection layer containing 20 g/m$^2$ of titanium dioxide and 2.0 g/m$^2$ of gelatin.

(3) A light-shielding layer containing 3.0 g/m$^2$ of carbon black and 2.0 g/m$^2$ of gelatin.

(4) A layer containing a cyan dye releasing redox compound having the following structure (0.44 g/m$^2$), tricyclohexyl phosphate (0.09 g/m$^2$) and gelatin (0.8 g/m$^2$)

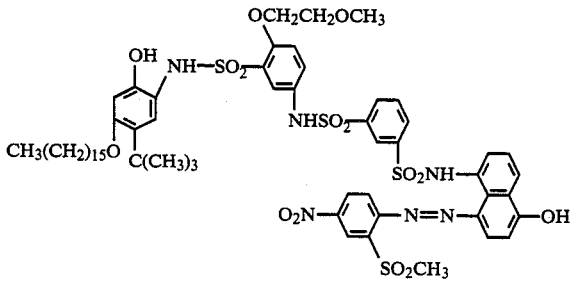

(5) A layer containing a red-sensitive internal latent image type direct reversal silver bromide emulsion (1.03 g/m$^2$ as silver content), gelatin (1.2 g/m$^2$), a nucleating agent having the following structure (0.05 mg/m$^2$) and 2-sulfo-5-n-pentadecylhydroquinone. sodium salt (0.13 g/m$^2$).

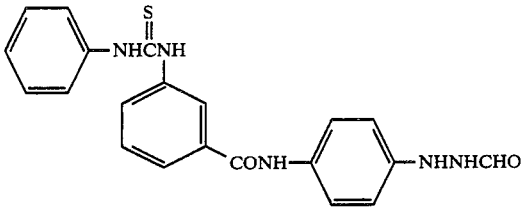

(6) An antistaining agent (color mixing-preventing agent)-containing layer which contains gelatin (0.8 g/m$^2$), 2,5-di-t-pentadecylhydroquinone (1.0 g/m$^2$), and polymethyl methacrylate (1.0 g/m$^2$).

(7) A layer containing a magenta dye releasing redox compound having the following structure I (0.21 g/m$^2$), a magenta dye releasing redox compound having the following structure II (0.11 g/m$^2$), tricyclohexyl phosphate (0.08 g/m$^2$), and gelatin (0.9 g/m$^2$).

Structure I

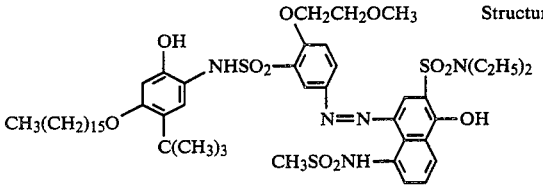

Structure II

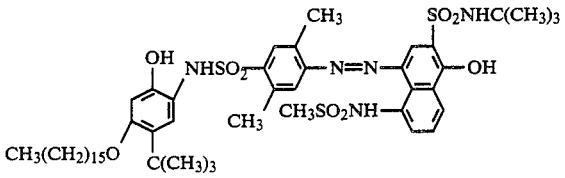

(8) A layer containing a green-sensitive internal latent image type direct reversal silver bromide emulsion (0.82 g/m$^2$ as silver content), gelatin (0.9 g/m$^2$), the same nucleating agent as in the layer (5) (0.03 mg/m$^2$), and 2-sulfo-5-n-pentadecylhydroquinone. sodium salt (0.08 g/m$^2$).

(9) The same layer as in (6).

(10) A layer containing a yellow dye releasing redox compound having the following structure (0.53 g/m$^2$), tricyclohexyl phosphate (0.13 g/m$^2$), and gelatin (0.7 g/m$^2$).

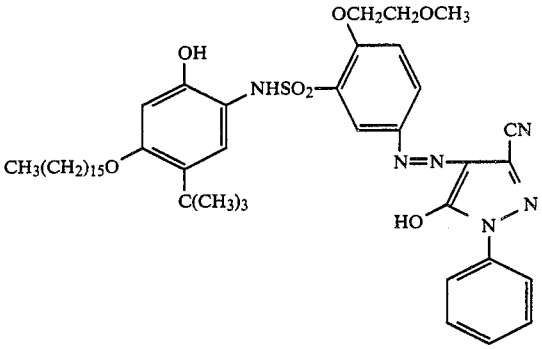

(11) A layer containing a blue-sensitive inner latent image type direct reversal silver bromide emulsion (1.09 g/m$^2$ as silver content), gelatin (1.1 g/m$^2$), the same nucleating agent as in the layer (5) (0.04 mg/m$^2$), and 2-sulfo-5-n-pentadecylhydroquinone. sodium salt (0.07 g/m$^2$).

(12) A layer containing gelatin (1.0 g/m$^2$).

A cover sheet was produced by applying the following layers (1')–(3') in turn to a transparent polyester support.

(1') A layer containing an 80/20 (weight ratio) copolymer of acrylic acid and butyl acrylate (22 g/m$^2$) and 1,4-bis-(2,3-epoxypropoxy)butane (0.44 g/m$^2$).

(2') A layer containing acetyl cellulose (100 g of acetyl cellulose was hydrolyzed to form 39.4 g of acetyl group) (3.8 g/m$^2$), a 60/40 (weight ratio) copolymer of styrene and maleic acid anhydride (molecular weight: about 50,000) (0.2 g/m$^2$), and 5-($\beta$-cyanoethylthio)-1-phenyltetrazole (0.115 g/m$^2$).

(3') A layer containing an 85:12:3 (weight ratio) copolymer of vinylidene chloride, methyl acrylate and acrylic acid (2.5 g/m$^2$) and a polymethyl methacrylate latex (particle size: 1–3 $\mu$m) (0.05 g/m$^2$).

The above-described light-sensitive material and the above-described cover sheet were superposed to produce a film unit.

Then, a processing solution having the following composition was prepared.

| | |
|---|---|
| 1-p-Tolyl-4-hydroxymethyl-4-methyl-3-pyrazolidinone | 12 g |
| Methyl hydroquinone | 0.1 g |
| 5-Methylbenzotriazole | 3.5 g |
| Sodium sulfite (anhydrous) | 0.2 g |
| Carboxymethyl cellulose Na salt | 43 g |
| Potassium hydroxide | 56 g |
| Benzyl alcohol | 1.5 ml |
| Carbon black | 150 g |
| Water to make | 1 Kg |

After the above-described processing solution was put in a destructible container (wherein the container was interrupted from oxygen and it would be placed in such a position that the content in the container was spread between the light-sensitive material and the cover sheet in the film unit when pressure is applied by the pressing members during processing of the film unit), it was subjected to heat treatment together with the container under the following conditions. Thereafter, each container was placed between the light-sensitive material and the cover sheet in each film unit to unify in a body.

| | |
|---|---|
| Processing solution A | No heating (for comparison) |
| Processing solution B | Heating to 45° C. for 30 days (The present invention) |
| Processing solution C | Heating to 50° C. for 15 days (The present invention) |
| Processing solution D | Heating to 60° C. for 3 days (The present invention) |
| Processing solution E | Heating to 50° C. for 3 days (The present invention) |

Performances of Processing solutions A–E which were allowed to stand at room temperature for 1 year and 8 months were compared with performances of the corresponding Processing solutions A'–E' (for control) which were obtained by preserving the Processing solutions A–E in a frozen state for 1 year and 8 months.

The processing solution preserved in a frozen state is taken as a processing solution just after preparation, since it is believed that frozen processing solution causes no change in its performance during preservation. The changes of performances of the processing solutions A–E due to passage of time were compared based on the frozen processing solutions A'–E'.

For the comparisons, tungsten light of 2854° K. (tungsten lamp) was used, and the above-described film unit was imagewise exposed through a continuous wedge by applying the light obtained by passing through a Davis Gibbson Filter to convert it into the light of 4800° K. type, applied to the side of the transparent base of the light-sensitive layers. (The maximum exposure in this case was 10 CMS).

Figure 1:
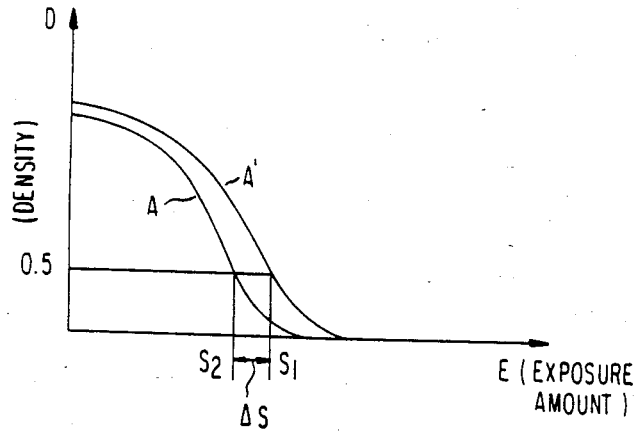
FIG. 1 is an explanatory graph of a characteristic curve of the light-sensitive material developed with the processing solution and a characteristic value.

The exposed film unit was developed at 25° C. with the above-described processing solutions by passing through pressing rolls, and variations of photographic properties were evaluated. The varations of photographic properties were evaluated as characteristic values ΔS, as is shown in FIG. 1. FIG. 1 shows characteristic curves of the light-sensitive material developed with the processing solution A and A'. Characteristic curves relating to the processing solutions B and B', C and C', D and D' and E and E' are almost the same as that relating to the processing solution A.

The characteristic value ΔS means the difference between $S_2$ and $S_1$, which is represented as the unit mm, wherein $S_1$ represents an exposure amount (logarithmic value) corresponding to the transfer density of 0.5 (measurement of reflection density) in the characteristic curve of the light-sensitive material developed with the processing solutions A–E which were allowed to stand at room temperature for 1 year and 8 months, and $S_2$, represents an exposure amount (logarithmic value) corresponding to the transfer density of 0.5 in the characteristic curve of the light-sensitive material developed with the processing solutions A'–E' preserved in a frozen state (5 mm corresponds to logarithm of exposure amount of 0.1). The results obtained are shown in Table 1.

TABLE 1

| Processing solution | Yellow | Magenta | Cyan | Note |
|---|---|---|---|---|
| A | 12 | 8 | 4 | Comparison |
| B | 1 | <1 | <1 | The present invention |
| C | 1 | <1 | <1 | The present invention |
| D | 1 | <1 | <1 | The present invention |
| E | <0.5 | <0.5 | <0.5 | The present invention |

As is obvious from the numerical values in Table 1, ΔS in case of using processing solutions which were subjected to heat treatment for a given period of time according to the present invention is very small as compared with that in the case of using the processing solution which was not subjected to heat treatment. Namely, it is understood that the change of performances of the developing solutions by the passage of time is remarkably reduced, and this phenomenon is particularly remarkable in the blue-sensitive layer nearest to the position where the processing solution is spread.

While the invention has been described in detail and with reference to specific embodiments thereof, it will be apparent to one skilled in the art that various changes and modifications can be made therein without departing from the spirit and scope thereof.

We claim:

1. A color diffusion transfer photographic element which comprises a support having provided thereon at least one silver halide emulsion layer containing a non-diffusible redox compound capable of releasing a diffusible dye or a precursor thereof by processing with an alkaline processing solution in the presence of a silver halide developing agent after exposure to light, wherein (a) said alkaline processing solution contains a 3-pyrazolidinone type developing agent, (b) said alkaine processing solution is contained in a container destructible by pressure, (c) said destructible container is assembled into the photographic element in such a position that the processing solution released from said container diffuses into the photographic layers, but said position does not interrupt exposure of the silver halide emulsion layer, and (d) said alkaline processing solution is subjected to a heat treatment under a substantially oxygen-free condition for at least T days, wherein T is represented by the formula $$\log T = \left(\frac{50 - X}{10}\right) \log 5 \qquad \text{(I)}$$

wherein X represents the maximum temperature, provided that X is about 40° C. or more and wherein said alkaline processing solution is heat treated before being assembled into the photographic element.

2. A color diffusion transfer photographic element as in claim 1, wherein the alkaline processing solution contained in the container destructible by pressure is subjected to a heat treatment at a maximum temperature of at least 50° C. for from 1 to 20 days.

3. A color diffusion transfer photographic element as in claim 1, wherein the alkaline processing solution contained in the container destructible by pressure is subjected to a heat treatment at a maximum temperature of about 50° C. for about 3 days.

4. A color diffusion transfer photographic element as in claim 1, wherein the 3-pyrazolidinone type developing agent is a 1-aryl-4-substituted-3-pyrazolidinone.

5. A color diffusion transfer photographic element as in claim 1, wherein the 3-pyrazolidinone type developing agent is represented by formula (II):

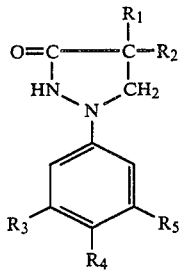

(II)

wherein $R_1$ and $R_2$ each represent a hydrogen atom, a lower alkyl group, or a hydroxyl substutited lower alkyl group, and $R_3$, $R_4$ and $R_5$ each represent a hydrogen atom, a hydroxyl group, an alkyl group, an alkoxy group, an aryloxy group, a sulfonamide group, or an aromatic group.

6. A color diffusion transfer photographic element as in claim 5, wherein both $R_3$ and $R_5$ are hydrogen atoms and $R_4$ is a methyl group.

7. A color diffusion transfer photographic element as in claim 1, wherein the 3-pyrazolidinone is used in an amount of from about 1 g/l up to the solubility limit thereof.

8. A color diffusion transfer photographic element as in claim 4, wherein the 3-pyrazolidone is used in an amount of from about 1 g/l up to the solubility limit thereof.

9. A color diffusion transfer photographic element as in claim 5, wherein the 3-pyrazolidinone is used in an amount of from about 1 g/l up to the solubility limit thereof.

10. A color diffusion transfer photographic element as in claim 6, wherein the 3-pyrazolidinone is used in an amount of from about 1 g/l up to the solubility limit thereof.

11. A color diffusion transfer photographic element as in claim 1, wherein the 3-pyrazolidinone is used in an amount of from 5 to 20 g/l.

12. A color diffusion transfer photographic element as in claim 4, wherein the 3-pyrazolidinone is used used in an amount of from 5 to 20 g/l.

13. A color diffusion transfer photographic element as in claim 5, wherein the 3-pyrazolidinone is used in an amount of from 5 to 20 g/l.

14. A color diffusion transfer photographic element as in claim 6, wherein the 3-pyrazolidinone is used in an amount of from 5 to 20 g/l.

15. A color diffusion transfer photographic element which comprises a support having provided thereon at least one silver halide emulsion layer containing a non-diffusible redox compound capable of releasing a diffusible dye or a precursor thereof by processing with an alkaline processing solution in the presence of a silver halide developing agent after exposure to light, wherein (a) said alkaline processing solution contains a 3-pyrazolidinone type developing agent, (b) said alkaline processing solution is contained in a container destructible by pressure, (c) said destructible container is assembled into the photographic element in such a position that the processing solution released from said container diffuses into the photographic layers, but said position does not interrupt exposure of the silver halide emulsion layer, and (d) said alkaline processing solution is subjected to a heat treatment under a substantially oxygen-free condition for at least T days, wherein T is represented by the formula $$\log T = \log 2 + \left(\frac{50 - X}{10}\right) \log 5$$

wherein X represents the maximum temperature, provided that X is about 40° C. or more and wherein said alkaline processing solution undergoes heat treatment before being assembled into the photographic element.

16. A color diffusion transfer photographic element as in claim 15, wherein the alkaline processing solution contained in the container destructible by pressure is subjected to a heat treatment at a maximum temperature of at least 50° C. for 1–20 days.

17. A color diffusion transfer photographic element as in claim 1, wherein the maximum temperature applied is 80° C. or less.

18. A color diffusion transfer photographic element as in claim 15, wherein the maximum temperature applied as 80° C. or less.

* * * * *